343-756
8/9/77 OR 4,041,499
SR

United States Patent [19]

Liu et al.

[11] 4,041,499

[45] Aug. 9, 1977

[54] COAXIAL WAVEGUIDE ANTENNA

[75] Inventors: Charles Chung-Yeh Liu, Dallas; James Alec Fuller, Richardson, both of Tex.

[73] Assignee: Texas Instruments Incorporated, Dallas, Tex.

[21] Appl. No.: 629,723

[22] Filed: Nov. 7, 1975

[51] Int. Cl.[2] ..... H01Q 13/06; H01Q 13/08

[52] U.S. Cl. ..... 343/756; 343/777; 343/786

[58] Field of Search ..... 343/756, 776, 786, 16 M, 343/777

[56] References Cited

U.S. PATENT DOCUMENTS

| | | | |
|---|---|---|---|
| 3,508,277 | 4/1970 | Ware et al. | 343/786 |
| 3,665,481 | 5/1972 | Woo | 343/786 |
| 3,864,687 | 2/1975 | Walters et al. | 343/786 |

*Primary Examiner*—Eli Lieberman
*Attorney, Agent, or Firm*—Harold Levine; René E. Grossman; Alva H. Bandy

[57] ABSTRACT

Disclosed is a coaxial waveguide antenna. In a basic form the coaxial waveguide horn for the antenna comprises an inner section operating in a Σ (sum) mode only and an outer section operating in a Δ (difference) mode only. Where required for broadband (i.e., for more than 1 octave), intermediate sections operating in Σ and Δ modes are provided. The basic structure operates in the linear mode; for polarization diversity and circular polarization, a polarizer is placed in front of the horn, or a dielectric sheet is positioned within a coaxial waveguide section at an angle of 45° as to the E field, or by feeding the coaxial waveguide with six or more number of probes.

7 Claims, 10 Drawing Figures

Fig. 1
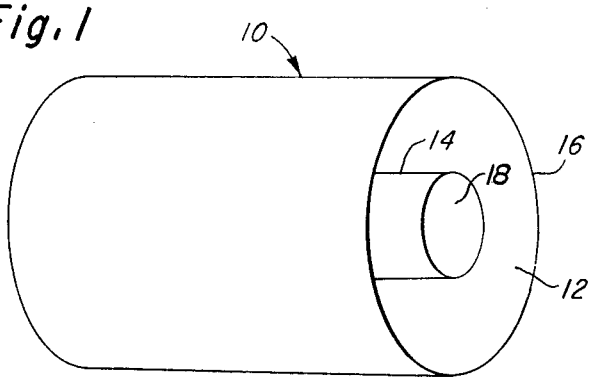
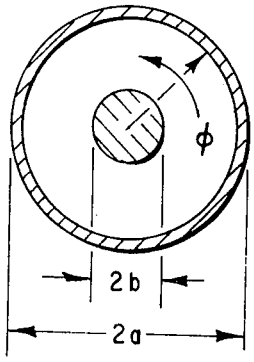
Fig. 2a
Fig. 2b
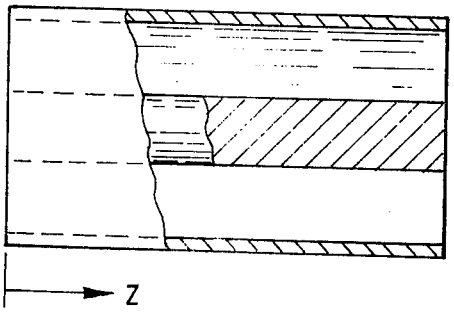

COAXIAL WAVEGUIDE ANTENNA

This invention pertains to monopulse antennas, and more particularly, to a sum (Σ) and difference (Δ) radiation pattern antenna.

In the past, spiral antennas have been used for two channel monopulse DF applications. A spiral antenna is fed electromagnetic energy at the spiral apex and the energy radiates from the spiral with a rotation effect. Many problems or disadvantages attend the performance of spiral antenna; and as these problems are inherent in the spiral antenna's structure, they are difficult, if not impossible, to solve or overcome. For example, because the spiral antenna is tip or apex fed, it is limited in its high frequency (high frequency end limited). Further, because the electromagnetic energy radiates from a spiral antenna, it exhibits DF plane rotation which requires complicated circuitry to overcome. Also, as the spiral antenna is fed at its apex, multi-octave complex electromagnetic energy feed networks are required. Finally, a spiral antenna is limited by its power handling capability. Therefore, a spiral antenna is generally used for receiving only. A coaxial horn can be used either for high power transmitting or low power receiving application.

Prior to this invention, conical horn antennas have been used to radiate radio waves into space either only in sum patterns or in the sum and difference patterns only from the same section.

Accordingly, an object of the invention is to provide a coaxial waveguide horn antenna for monopulse applications.

A further object of the invention is to provide a coaxial waveguide horn antenna for monopulse radar covering selected high frequency bands for active/passive DF application.

Another object of the invention is to provide a coaxial waveguide horn antenna having improved direction finding performance over a wide frequency range.

Yet another object of the invention is to provide a two channel monopulse DF antenna which is simple and economical to fabricate.

Briefly stated, the coaxial-waveguide horn antenna for a monopulse application includes a coaxial waveguide horn coupled through one or more hybrids to the transmit/receive (TR) circuits of a radar employing, for example, a power-amplifier transmitter and a superheterodyne receiver. The one or more hybrids generate sum (Σ) and difference (Δ) phase signals for the coaxial waveguide horn antenna. The coaxial waveguide horn antenna includes an inner section having a circumference of one wavelength (λ) for transmitting and receiving sum (Σ) (in phase) signals, an outer section having a circumference of two wavelengths (λ) for transmitting and receiving difference (Δ) (out of phase) signals, and if the frequency is broadband, one or more intermediate sections for transmitting sum and difference signals at frequencies of octaves intermediate the high and low frequencies.

In one embodiment, a two probe feed system is used to feed each section of the coaxial waveguide horn antenna to produce linearly polarized radiation. In another embodiment, for circular polarized radiation of the sum signals, a four probe feed system is used. For circularly polarizing, both sum and difference signals, six or eight or more probes are used. Circularly polarized radiation can also be produced with the two probe feed by positioning a dielectric sheet in each section at a 45° angle as to the electric field, or by forming a circular polarizer in front of the coaxial waveguide antenna horn.

The novel features believed to be characteristic of this invention are set forth in the appended claims. The invention itself, however, as well as other objects and advantages thereof may best be understood by reference to the following detailed description of illustrative embodiments when read in conjunction with the accompanying drawings in which:

FIG. 1 is an isometric view of a coaxial waveguide;

FIGS. 2*a* and *b* are, respectively, transverse and longitudinal sectional views of the coaxial waveguide of FIG. 1 on which is shown the coordinate system for the field equations.

FIGS. 3*a* and *b* are cross sectional views of the coaxial waveguide of FIG. 1 showing the field distributions for the $TE_{11}$ (Σ) mode and the $TE_{21}$ (Δ) mode, respectively.

FIGS. 4*a* and *b* are views of the $TE_{11}$ (Σ) mode and $TE_{21}$ (Δ) mode, respectively.

Figure 3A:
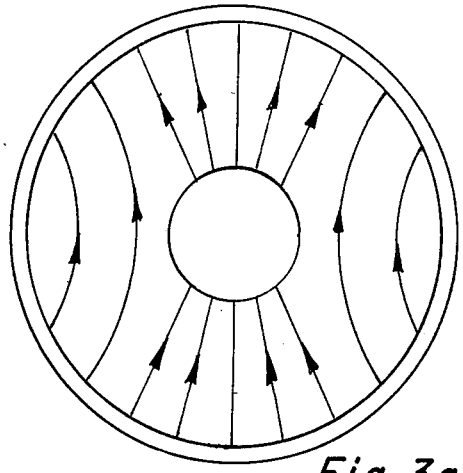

Referring now to FIG. 1 in which there is shown, for discussion purposes, a section of coaxial waveguide 10. The coaxial waveguide has a section 12 formed by the space between an inner wall 14 and an outer wall 16. The inner wall 14 has a circumference equal to one wavelength of the lowest frequency desired and the outer wall 16 has a circumference equal to two wavelengths of this lowest frequency. A center section 18 has no upper limit for the highest frequency; thus, it generally becomes a circular waveguide. Further, as the inner section is probe fed through the outer wall, there is no microwave energy feed line limiting the size of the inner section as there is in the spiral of the planar spiral antenna.

A coaxial waveguide operated in the principal (TEM) mode will transmit a wave of any frequency. High order (TE and TM) modes can also propagate with the TEm mode. Nevertheless, below cut-off the high order modes are excited only at the source of energy or at a discontinuity in the line and are rapidly attenuated with distance and draw no real power. By properly chosing the line dimensions and exciting the line at a frequency above the critical or cut-off mode, the higher (TE) modes are selectively excited. Further, the center or inner wall of a coaxial waveguide has loading effects similar to the ridge on rectangular waveguide. Thus, extremely wide-bandwidth and single-mode performance with moderate attenuation properties is produced. The cut-off wavelength (λc) and operating frequency bandwidth of coaxial waveguide is a function of the diametric ratio of the inner and outer walls.

The field components for all higher modes may be expressed in terms of the cylindrical coordinates *r*, *ϕ*, and *z* as shown in FIGS. 2*a* and *b.* For TE waves $$H_z = (k^2/jw\mu)e^{jwt-\gamma z}[AJ_n(kr) + BN_n(kr)]\cos n\phi$$
$$H\phi = (\gamma/rk^2)(\delta Hz/\delta\phi)$$

$$Hr = -(\gamma/k^2)(\delta Hz/\delta r)$$
$$Zw = jw\mu/r$$
$$Er = ZwH\phi\ k^2 = ko^2 + \gamma^2$$
$$E\phi = -ZwHr\ ko - (2\pi/\lambda)$$

Figure 3B:
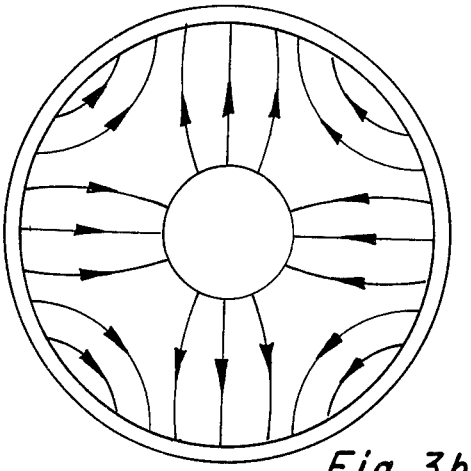
Figure 4A:
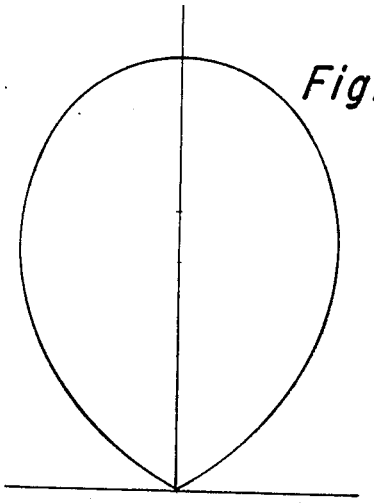
Figure 4B:
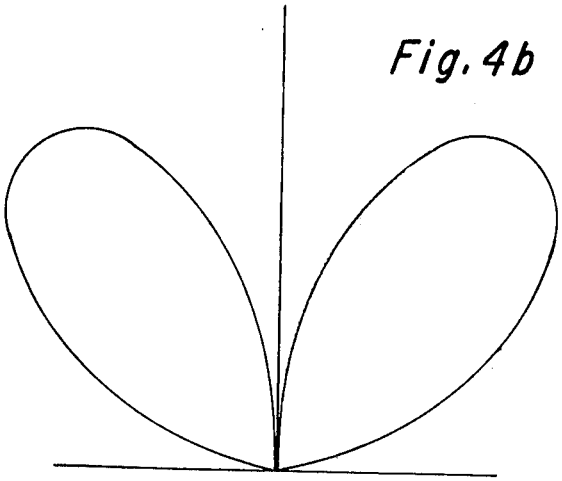

$J_n$ and $N_n$ are the Bessel functions of the first and second kind. The dominant mode for the coaxial waveguide at high modes is the $TE_{11}$ (FIG. 3*a*). The $TE_{11}$ mode provides a linear polarization with maximum radiation on the coaxial waveguide axis (FIG. 4*a*). The other high mode suitable for monopulse application is the $TE_{21}$ mode (FIG. 3*b*). The $TE_{21}$ mode has a null in its radiation pattern on the coaxial waveguide axis (FIG. 4*b*). The $TE_{11}$ mode is the sum (Σ) or zero phase shift radiation pattern and the $TE_{21}$ mode is the difference (Δ) or out of phase radiation pattern.

Figure 5:
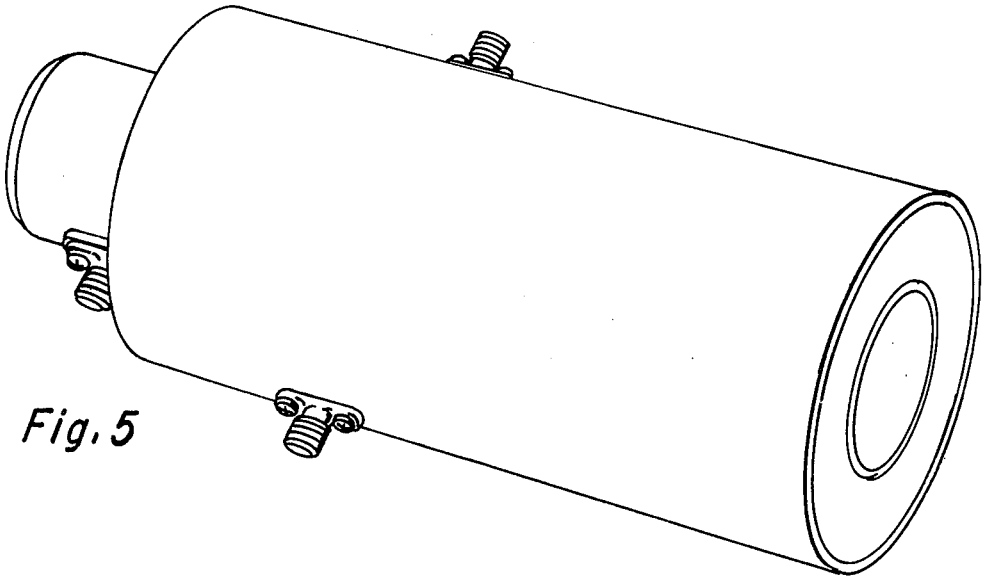
FIG. 5 is an isometric view of the coaxial waveguide horn antenna constituting the subject matter of this invention.
Figure 6:
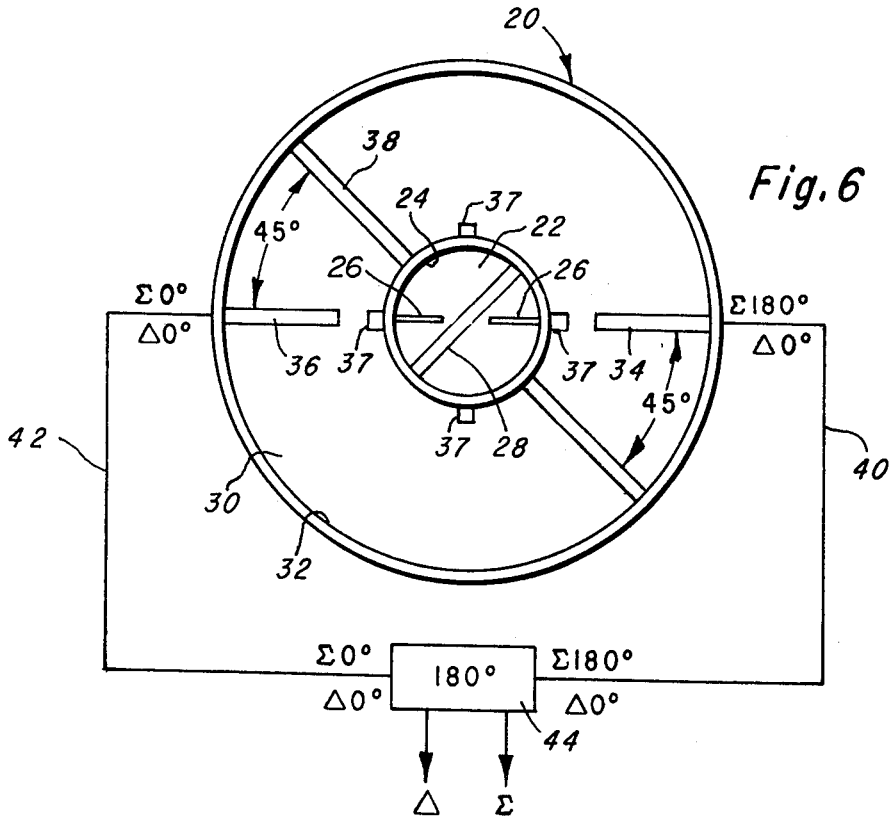
FIG. 6 is a view partly in cross section and partly in schematic form to show the fabrication of the coaxial waveguide horn antenna of FIG. 5 and its electrical feed circuit.

Referring now to FIGS. 5 and 6 for a description of a preferred embodiment, FIG. 6 shows a cross sectional view of a two sectional coaxial waveguide horn antenna 20. The single sectional coaxial waveguide horn antenna 20 has a first section 22 for a frequency bandwidth of about 8–16 GHz. At this bandwidth, the inner wall is omitted from the first section and an outer wall 24 forms a circular waveguide. The first section is fed by two oppositely disposed probes 26. The probes 26 feed electromagnetic energy into the first section for transmission and receive reflected energy entering the first section during the receive cycle. For circular polarized radiation, a dielectric member 28 is positioned within the first section at an angle of 45° as to the electric field. The direction of the electric field is along the axis of the feed probes 26. The probes 26 may be coaxial cable connectors and the dielectric member 28 may be, for example, fiber glass members. The probes 26 are coupled to the sum (Σ, 180° phase shift) terminals of a hybrid circuit 44, which is identical to that shown for the second or outer section. For clarity, the hybrid circuit is shown but once with the Σ and Δ signals designated thereon. It will be understood that as the Σ signals only are used in the first section 22 the Δ signals will terminate in a load.

The second section 30 (FIG. 6) of the coaxial waveguide horn antenna comprises an inner wall which is the outer wall 24 of the first section 22 and an outer wall 32. The inner wall 24 and outer wall 32 are concentric to each other and are made of a suitable conducting material such as aluminum or copper. Probes 34 and 36 are coupled to the second section through the outer wall 32. The probes are coaxial cable connectors. For circular polarized radiation, a dielectric member 38 is positioned within the second section 30 at a 45° angle as to the electric field. The probes 34 and 36 are coupled, respectively, through leads 40 and 42, which may be, for example, coaxial cables, to the difference ports of 180° hybrid 44. As this outer section utilizes only the Δ (out of phase) signals, the Σ signals will terminate in a load. A plurality of tapered impedance matching ridges 37, which as shown in FIG. 6 consist of four ridges spaced at 90° intervals about the inner wall 24, are provided to enhance the power transfer from the loads 40 and 42 to the second section 30. In addition the ridges 37 enhance desired mode selectivity, e.g., excitation and/or suppression. A suitable hybrid is an ANZAC 180° C hybrid. Hybrid 44 is coupled to the radar transmit and receive circuits.

In operation, an 8–16 GHz monopulse signal is applied to the sum (Σ, 180° phase shift) terminal of 180° hybrid 44. Hybrid 44 divides the power in half and feeds it in phase to the first section 22 through probes 26 where it is circularly polarized by circular polarizer 28 and radiates into space in the $TE_{11}$ mode Σ pattern shown in FIG. 4*a*. At the same time an 8–16 GHz monopulse signal is applied to the difference (Δ, 0° phase shift) terminal of 180° hybrid 44 where the power is divided in half and transmitted in phase through lead 40 probe 34 and 0° of phase through lead 42 to probe 36 into the second section 30 where it is circularly polarized by circular polarizer (dielectric 38) and radiated into space in the $TE_{21}$ mode Δ pattern shown in FIG. 4*b*.

Reflected energy received in phase by the first section 22 is in the sum mode of FIG. 4*a*, and energy received in the second section is out of phase or in the difference mode of FIG. 4*b*. If the coaxial waveguide horn antenna 20 is on target the sum and difference signals are 180° out of phase and a comparator of the radar receive circuit produces zero difference signals. If the antenna 20 is not on target, the comparator will produce a signal proportional to phase change which may be used to produce guidance signals for a moving vehicle.

Figure 7:
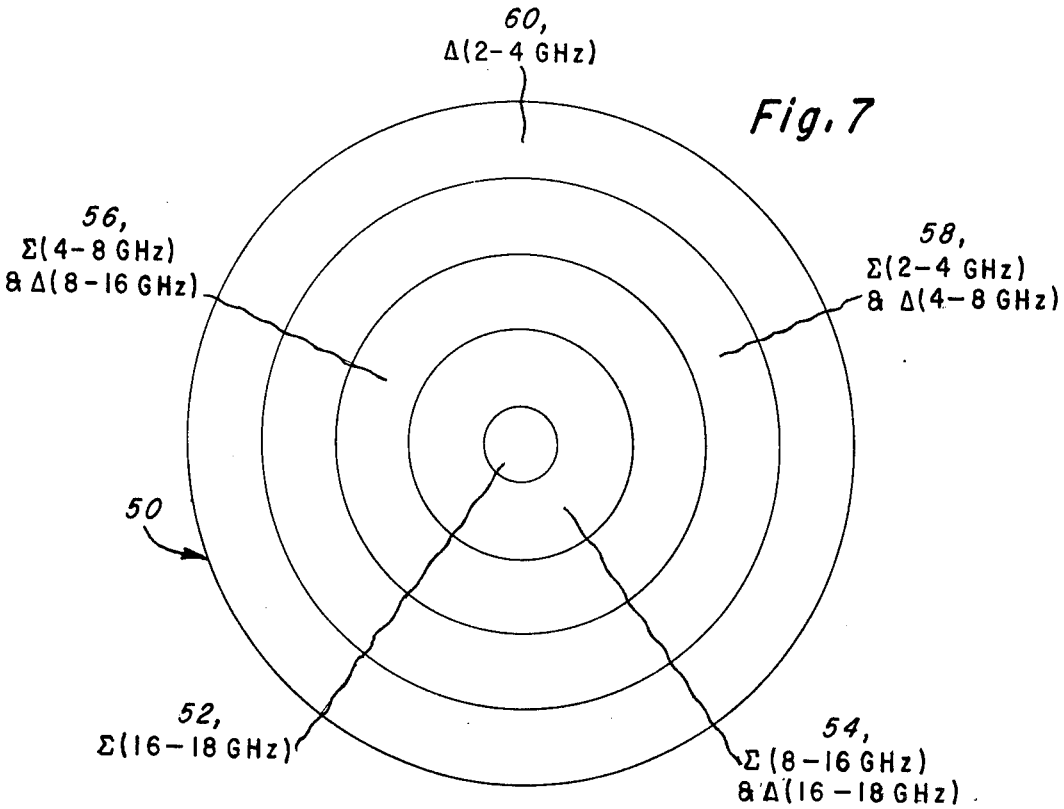
FIG. 7 is a cross sectional view of another embodiment of the coaxial waveguide horn antenna.

Referring now to FIG. 7, a cross-sectional view of a broadband coaxial waveguide antenna is shown. The broadband coxial waveguide antenna 50 may have, for example, a 2–18 GHz freuency range and consists of an inner section 52; three intermediate sections 54, 56, and 58; and an outer section 60. Each section is fabricated as shown in FIG. 6 and is electrically coupled to a 180° hybrid circuit such as that also shown in FIG. 6. The 180° hybrid for the inner section 52 has its sum (Σ) terminals coupled to a 16–18 GHz bandwidth source of power and its difference terminal, as it is not used, coupled to a load. Intermediate section 54 has its 180° hybrid coupled as follows: the sum (Σ) terminal coupled to an 8–16 GHz power source and its difference (Δ) terminal coupled to a 16–18 GHz power source. Whilst intermediate sections 56 and 58 have their 180° hybrids coupled as follows: for intermediate section 56, the sum (Σ) terminal is coupled to a 4–8 GHz frequency source of power and the difference (Δ) terminal coupled to an 8–16 GHz frequency source of power; and for intermediate section 58, the sum (Σ) terminal is coupled to a 2–4 GHz frequency source of power and the difference (Δ) terminal coupled to a 4–8 GHz frequency source of power. The outer section 60 has its 180° hybrid circuit sum terminals coupled to a load, and its difference terminal coupled to a 2–4 GHz frequency power source. With this coaxial waveguide horn antenna, the antenna pattern is that shown in FIGS. 4*a* and *b*.

If a single broadband source of power is used, a multiplexer is required between the hybrid circuit terminals and the broadband source of power. When individual power sources are used the frequency bands of the antenna are selected to eliminate the requirement for a multiplexer. If the coaxial waveguide horn antenna system is used as a receiver for a broadband monopulse system, a multiplexer is required to produce a single broadband signal.

The antenna is a reciprocal device and therefore it may be used in a receiver system as well as a transmitter system. When used in a receiver system, the hybrid circuits are connected to a monopulse receiver rather than the transmitter source of power.

Although severl embodiments of the invention have been described herein, it will be apparent to a person skilled in the art that various modifications to the details of construction shown and described may be made without departing from the scope of this invention. For example, one skilled in the art can substitute either a four probe feed system and produce circular polarization in the sum (Σ) mode or a six or more probe feed system and produce circular polarization in the sum and difference modes for the two probe feed system and dielectric for circular polarization.

What is claimed is:

1. A coaxial waveguide horn antenna system comprising a source of electromagnetic monopulse signals, a hybrid circuit means coupled to the source of electromagnetic monopulse signals for producing sum and difference monopulse signals, said hybrid circuit means including first and second 180° hybrids, said first hybrid being connected to a source of power at a first selected frequency bandwidth for producing a sum signal, said second hybrid being connected to a source of power at a second selected frequency for producing a difference signal, and a coaxial waveguide horn antenna for radiating monopulse signals in sum and difference patterns, said coaxial waveguide horn antenna comprising first and second sections, said first section coupled to the first hybrid for radiating the sum signal in a sum pattern, and said second section coupled to the second hybrid for radiating the difference signal in a difference pattern, said first and second sections being formed by a plurality of spaced concentric cylindrical walls, the outer wall of the first section forming the inner wall of the second section, the inner wall of the second section having a circumference substantially equal to one wavelength of the lowest frequency of its bandwidth and the outer wall of the second section having a circumference substantially equal to two wavelengths of the lowest frequency of the bandwidth.

2. A coaxial waveguide horn antenna system according to claim 1 wherein the sum signal of the first section of the coaxial waveguide horn antenna is in the $TE_{11}$ mode, and the difference signal of the second section of the coaxial waveguide antenna is in the $TE_{21}$ mode.

3. A coaxial waveguide horn antenna system according to claim 1 wherein said first and second sections further include a dielectric sheet disposed at 45° as to the electric field for circularly polarized radiation.

4. A coaxial waveguide horn antenna system according to claim 1 wherein said second section includes a plurality of spaced impedance matching ridges on the inner wall for efficient transfer of the power from the hybrid feed lines to the second section mode selectivity.

5. A coaxial waveguide horn antenna system comprising: a source of electromagnetic signals, a hybrid circuit means coupled to the source of electromagnetic signals for producing sum and difference signals, said hybrid circuit means including a first hybrid circuit coupled to a source of power at a first frequency for the sum signals and a second hybrid circuit coupled to a source of power at the first frequency for the difference signals, and a coaxial waveguide horn antenna having a first section for generating the sum pattern and a second section concentric with the first section for generating the difference pattern, said first section having an outer wall forming the inner wall of the second section and having a circumference substantially equal to one wavelength of the lowest frequency, and said second section having an outer wall having a circumference substantially equal to two wavelengths of the lowest frequency of the bandwidth whereby the first section radiates sum signals at a first frequency and the second section radiates difference signals at the first frequency.

6. A coaxial waveguide horn antenna system according to claim 5, wherein said second hybrid circuit means is connected to a source of power at a first frequency for the difference signal and a second frequency for the sum signal, said second frequency being not less than one octave of the first frequency, and further including a third section wherein the outer wall of the second section forms the inner wall of the third section and the outer wall of the third section has a circumference substantially equal to two wavelengths of the lowest frequency of the bandwidth whereby the second section radiates a sum pattern at the second frequency and the third section radiates a difference signal at the second frequency.

7. A coaxial waveguide horn antenna system according to claim 5 wherein said hybrid circuit means includes at least six probes in each coaxial section for broadband circular polarization.

* * * * *